US006933911B2

(12) United States Patent
Suzuki

(10) Patent No.: US 6,933,911 B2
(45) Date of Patent: Aug. 23, 2005

(54) PLASMA DISPLAY DEVICE, LUMINANCE CORRECTION METHOD AND DISPLAY METHOD THEREOF

(75) Inventor: Yoshio Suzuki, Kanagawa (JP)

(73) Assignee: Sony Corporation, Tokyo (JP)

( * ) Notice: Subject to any disclaimer, the term of this patent is extended or adjusted under 35 U.S.C. 154(b) by 295 days.

(21) Appl. No.: 10/328,688

(22) Filed: Dec. 23, 2002

(65) Prior Publication Data

US 2003/0122743 A1 Jul. 3, 2003

(30) Foreign Application Priority Data

Dec. 27, 2001 (JP) ..... P2001-397002
Feb. 20, 2002 (JP) ..... P2002-042961
Jul. 18, 2002 (JP) ..... P2002-210070

(51) Int. Cl.[7] ..... G09G 3/28
(52) U.S. Cl. ..... 345/60; 345/63; 345/690; 315/169.4
(58) Field of Search ..... 345/60–72, 690–693; 315/169.1, 169.4

(56) References Cited

U.S. PATENT DOCUMENTS 6,037,917 A * 3/2000 Kawakami ..... 345/63
6,326,938 B1 * 12/2001 Ishida et al. ..... 345/63
6,496,165 B1 * 12/2002 Ide et al. ..... 345/60
6,680,732 B2 * 1/2004 Yoo ..... 345/173
6,686,698 B2 * 2/2004 Takeuchi et al. ..... 315/169.2
2003/0090488 A1 * 5/2003 Yoo ..... 345/473

* cited by examiner

*Primary Examiner*—Xiao Wu
(74) *Attorney, Agent, or Firm*—Sonnenschein, Nath & Rosenthal LLP

(57) ABSTRACT

A plasma display device comprises an area ratio detection means for detecting the area ratio of pixels having any luminance higher than a predetermined value in a display region; and a sustain frequency adjust means for adjusting, in accordance with the detected area ratio, the frequency or number of sustain pulses inputted to paired sustain electrodes in such a manner that the luminance in the display region satisfies a predetermined reference value. In this device, the frequency or number of the sustain pulses inputted to the paired sustain electrodes is adjusted in accordance with the detected area ratio, so that the luminance is always corrected to the reference value to thereby achieve proper expression of preset gradations.

11 Claims, 14 Drawing Sheets

PLASMA DISPLAY DEVICE, LUMINANCE CORRECTION METHOD AND DISPLAY METHOD THEREOF

BACKGROUND OF THE INVENTION

The present invention relates to a plasma display device, a luminance correction method and a display method thereof adapted for carrying out luminance correction in the plasma display device where display is performed by utilizing AC plasma discharge.

A plasma display panel (PDP) is adapted for constituting a thin structure with a great screen, and future development is expected particularly in realizing large-size display devices.

The plasma display panel of such a device is composed of two glass substrates opposed to each other and joined together with a discharge gas sealed therein. A pair of parallel sustain electrodes are disposed on the front glass substrate, and an address electrode is disposed on the back glass substrate in a direction to intersect with the sustain electrodes. The inside of one substrate is coated with a phospher layer. When a predetermined voltage is applied to the sustain electrodes, plasma discharge is generated between the paired electrodes to radiate ultraviolet rays, which are then incident upon the phospher layer to emit light therefrom. FIG. 15 is a schematic diagram showing an electrode structure on a display panel where pixels of m×n dots are provided. There are arranged n sets (X1, Y1, X2, Y2, . . . , Xn, Yn) of paired sustain electrodes 107X, 107Y, and m sets (A1, A2, . . . , Am) of address electrodes 103A, wherein the paired sustain electrodes 107 intersect with the address electrodes 103A to constitute a matrix in which a pixel is positioned at each intersection, as indicated by dotted lines in this diagram.

Emission of light per pixel is normally controlled at three steps, and respective operation periods are termed a reset period, an address period and a (discharge) sustain period. In a selective erase system for example, voltages of the waveforms shown in FIGS. 16A to 16C are applied, during the individual operation periods, to the three electrodes constituting each pixel. During the reset period, the entire sustain electrodes 107X and 107Y are discharged and the wall charges in the entire pixel regions are stored uniformly, so that the data stored previously in the pixels are wholly erased and the entire screen is kept in an even charged state. In the next address period, a binary state is formed depending on the presence or absence of the wall charge, and the pixel to be driven for emission of light is selected. At this time, addressing is executed in the following procedure with the sustain electrodes 107Y (Y1, Y2, . . . , Yn) being used as scanning electrodes and the address electrodes 103A as data electrodes, respectively.

Pulses are inputted sequentially to the sustain electrodes 107Y (Y1, Y2, . . . , Yn) at predetermined timings, and simultaneously data pulses corresponding to emission/non-emission of light from the pixels selected according to the combination with the voltage-applied sustain electrodes 107Y (in this case, relative to the non-emission pixels) are inputted to the m sets of the entire address electrodes 103A (A1, A2, . . . , Am) synchronously with the scanning timing on the sustain electrodes 107Y side. As a result, a discharge is generated in the non-emission pixel, and the wall charge is erased. Subsequently in the sustain period, an AC pulse voltage (sustain pulse) is applied to the paired sustain electrodes of the entire pixels. At this time, only the pixels having a residual wall charge reach a discharge start voltage selectively, and the generated discharge is sustained so that the light is emitted continuously during this period.

In this manner, the plasma display panel (PDP) executes display by emission of light under digital control. Generally, a sub-field method is employed as a driving system. The sub-field method is carried out by time-dividing one field of the display screen into some sub-fields and displaying the brightness gradations through time-width modulation of the light emission time. According to this method, the one-field display period (16.7 msec) is weighted in proportion to the bit place of N-bit image data, and is divided into N sub-fields where the light is emitted 2 k times (where k=0 to N−1) respectively. For example, if the image data per pixel are composed of 8 bits, the 1-field display period is divided into sub-fields SF1–SF8, and the number of times of light emission during the sub-fields SF1–SF8 is set sequentially to 20(1), 21(2), 22(4), . . . , 27(128). The emission of light can be performed 0 to 255 times by combining the on/off actions in such eight sub-fields, hence realizing display in 256 gradations.

This sub-field method is premised on that the luminance level at the time of light emission is kept always constant. Actually, however, in a display region where "ON" display pixels occupy a large area, a voltage drop is derived from the output impedance of a driving IC or from the wiring resistance of the display panel and so forth, whereby the luminance level at the time of light emission is reduced correspondingly to the drop of the supply voltage. For example, in case the regions being displayed brightly in the image are collected together to be more than certain dimensions, there exists a problem that such regions fail to be displayed at the desired brightness.

Another problem is to secure proper gradations in displaying a dark image. FIG. 18 graphically shows a typical video signal prior to being converted into image data. In the video signal, the luminance is expressed by an amplitude where a white peak level (white level) is maximum and a blanking level (black level) is minimum. Normally this signal is quantized to become image data in such a manner that 8 bits are allocated to the full range from a white level to a black level, whereby the full range luminance is expressed in 256 gradations. However, when a wholly dark image is to be displayed, the luminance differences of the entire screen are expressed by, e.g., 3 Low-order bits or so which correspond substantially to 8 gradations. In this case, since the original video signal is analog, the darkness is rendered homogeneous due to shortage of the number of gradations although infinitely fine luminance difference information is contained therein, whereby the luminance differences cannot be discriminated to consequently fail in attaining a desired screen quality.

SUMMARY OF THE INVENTION

The present invention has been accomplished in view of the problems mentioned above. It is an object of the invention to provide a plasma display device capable of performing exact display with proper expression of gradations.

According to one aspect of the present invention, there is provided a plasma display device comprising an area ratio detection means for detecting the area ratio of the pixels having any luminance higher than a predetermined value in a display region; and a sustain frequency adjust means for adjusting, in accordance with the detected area ratio, the frequency or number of the sustain pulses inputted to the paired sustain electrodes. Since the frequency or number of the sustain pulses inputted to the paired sustain electrodes is thus adjusted in accordance with the area ratio, the luminance can always be corrected to its reference value to consequently achieve proper expression of preset gradations.

The above and other features and advantages of the present invention will become apparent from the following description which will be given with reference to the illustrative accompanying drawings.

DETAILED DESCRIPTION OF THE PREFERRED EMBODIMENTS

Hereinafter some preferred embodiments of the present invention will be described in detail with reference to the accompanying drawings.

[First Embodiment]

Figure 1:
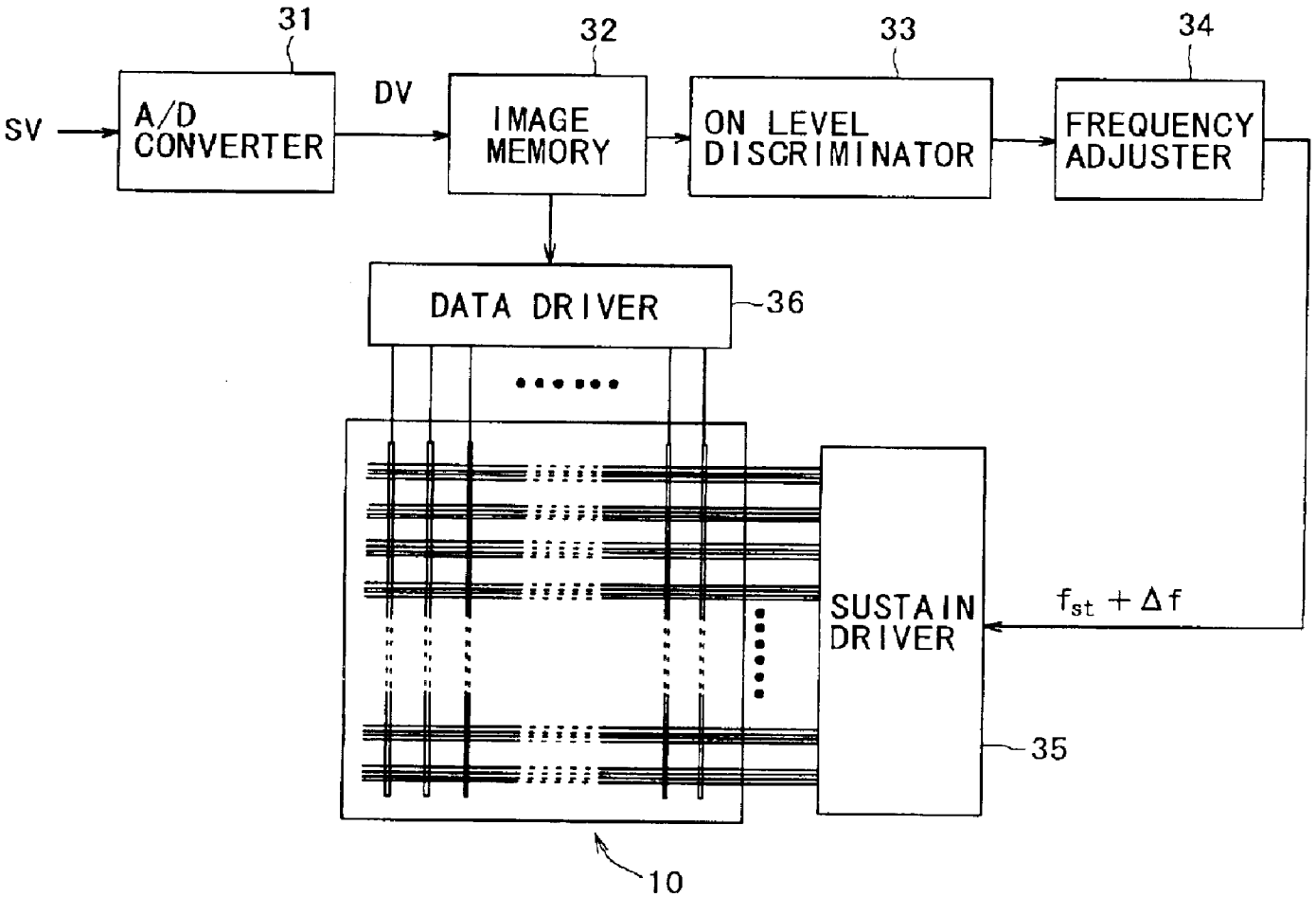
FIG. 1 is a block diagram showing the structure of a plasma display device according to a first embodiment.

A plasma display device according to a first embodiment of FIG. 1 is so contrived as to calculate any luminance fall derived from the area occupied by ON display pixels, and to correct the luminance by controlling sustain pulses. This plasma display device is structurally the same as the known one with the exception of an ON level discriminator 33 and a frequency adjuster 34 provided additionally. That is, this device principally comprises a display panel 10, an A/D converter 31 for converting the input analog video signal into a digital signal to generate video data DV, an image memory 32 for storing the video data DV thus generated, a sustain driver 35 for outputting driving pulses to the display panel 10, and a data driver 36. Although not shown for simplifying the diagram, a timing controller is provided to control the operation timing of such A/D converter 31, image memory 32, sustain driver 35 and data driver 36.

Figure 2:
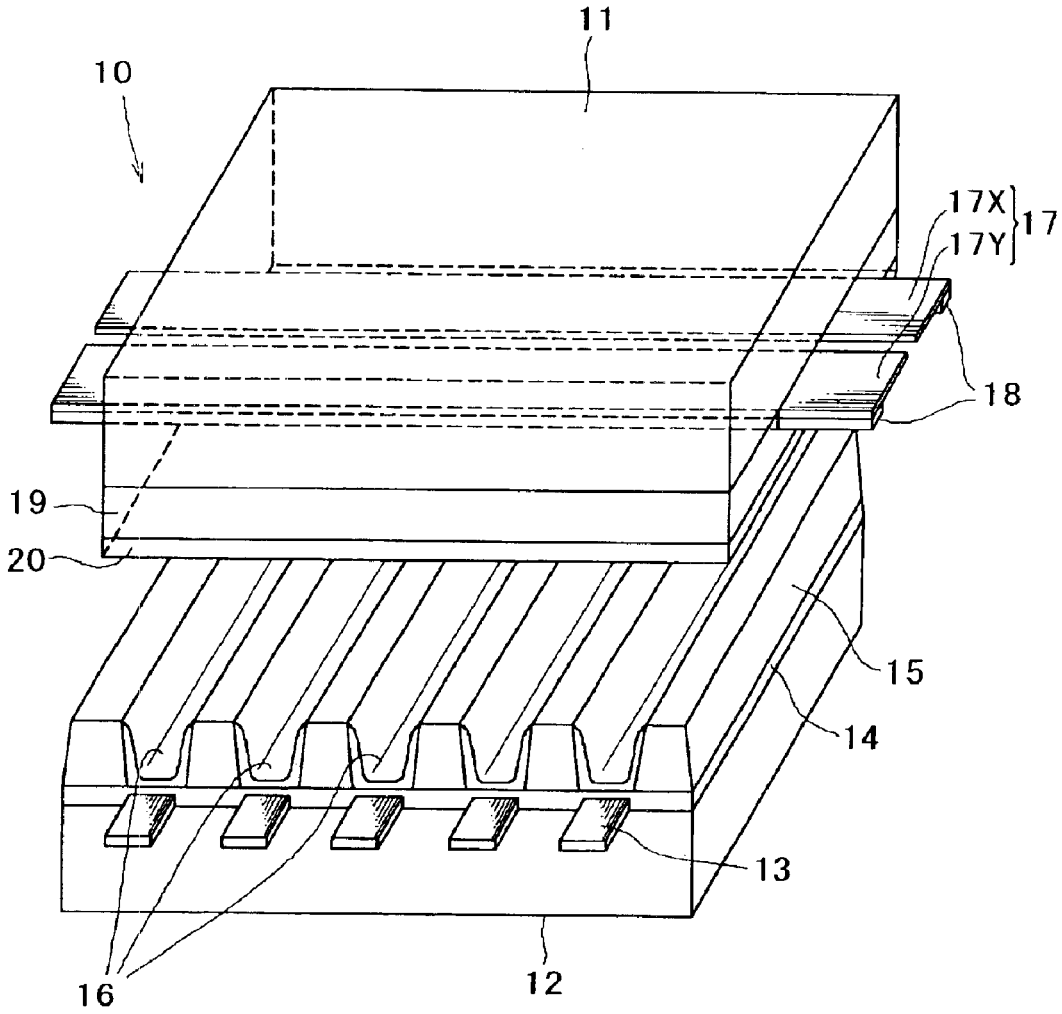
FIG. 2 is a perspective view showing the structure of a display panel in the first embodiment.

FIG. 2 shows a concrete structure of the display panel 10. In the display panel 10, as shown, a front glass substrate 11 and a back glass substrate 12 composed of transparent high-distortion point glass or soda lime glass are disposed opposite to each other via a discharge space. A plurality of paired sustain electrodes 17 (17X, 17Y) are provided in parallel on the front glass substrate 11. The sustain electrodes 17 are transparent and composed of ITO (indium-tin oxide) for example. In order to reduce the electric resistance, a bus electrode 18 composed of a metal such as aluminum is provided integrally along the lateral edge of each sustain electrode 17. The space between the paired sustain electrodes 17X and 17Y serves as a discharge gap at the time of sustain discharge, and it is generally 100 $\mu$m or so. A dielectric layer 19 of $SiO_2$ (silicon dioxide) and a protective layer 20 of MgO (magnesium oxide) for example are formed in this order on the paired sustain electrodes 17.

Meanwhile, address electrodes 13 of a metal such as aluminum are provided in parallel on the back glass substrate 12, and a dielectric layer 14 composed of $SiO_2$ for example is formed thereon, and further barrier ribs 15 are formed on the dielectric layer 14 as partition walls for dividing the discharge gap in conformity with the individual address electrodes 13 respectively. Each of the barrier ribs 15 is shaped to be trapezoidal in section and is composed principally of glass material of a low melting point, and a phosphor layer 16 is formed between the barrier ribs 15.

On the front glass substrate 11 and the back glass substrate 12 having such a structure, the sustain electrodes 17 (17X, 17Y) and the address electrodes 13 are so positioned as to be orthogonal in the directions of mutual extensions and constitute a matrix where pixels are arrayed at the individual intersections. FIG. 1 shows such an electrode configuration seen from the display screen side, wherein the sustain electrodes 17X and 17Y are connected electrically to a sustain driver 35, and the address electrodes 13 are connected electrically to a data driver 36. The two substrates 11 and 12 are joined together hermetically at the peripheral edges thereof, and a discharge gas is sealed under a predetermined pressure in the discharge space.

The A/D converter 31 quantizes the video signal SV, which is to be displayed, in units of field for example to thereby produce video data DV, and the image memory 32 stores the video data DV in units of bit plane corresponding to the data of one display image composed of bit data of each pixel for example. The image memory 32 supplies the video data DV to the data driver 36 and also to the ON level discriminator 33.

The ON level discriminator 33 detects the area ratio (display area ratio) which signifies the percentage of the pixels, which have any luminance higher than a predetermined value, in a predetermined display region. More specifically, the luminance in an on-state (=On display) is regarded as a reference value, and the display area ratio is expressed by the number of the ON display pixels existing in one display screen. This area ratio is indicated by counting the number of ON bits "1" per bit plane from the video data DV. Here, the display area ratio is obtained in such a manner that first the display screen is standardized by regions r of certain dimensions where the voltage drop is non-negligible, and there is counted the number of the regions r where the ON display pixels are existent at more than a predetermined rate. The display area ratio thus obtained is outputted to the frequency adjuster 34.

Figure 3A:
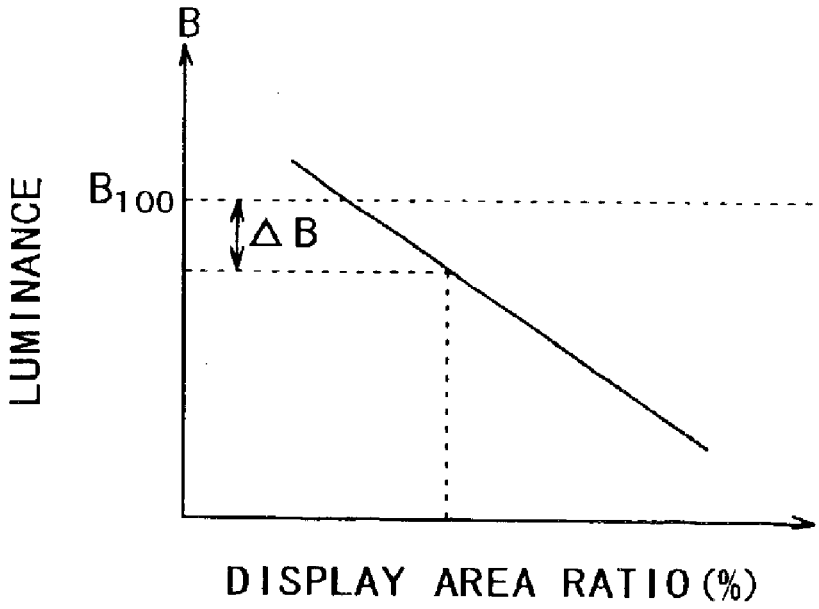
FIG. 3A is a characteristic diagram graphically showing the relationship between a display area ratio and a luminance.

The frequency adjuster 34 adjusts the frequency or number of sustain pulses inputted to the sustain electrodes 17X and 17Y, in accordance with the display area ratio obtained from the ON level discriminator 33, in a manner that the luminance in each display region satisfies the reference value. FIG. 3A graphically shows the relationship between the ON display area (ratio) and the luminance. As shown in this graph, the luminance in the actual device decreases with an increase of the area of the ON display pixels in the screen, and becomes lower than the reference value B100 (100% luminance).

Figure 3B:
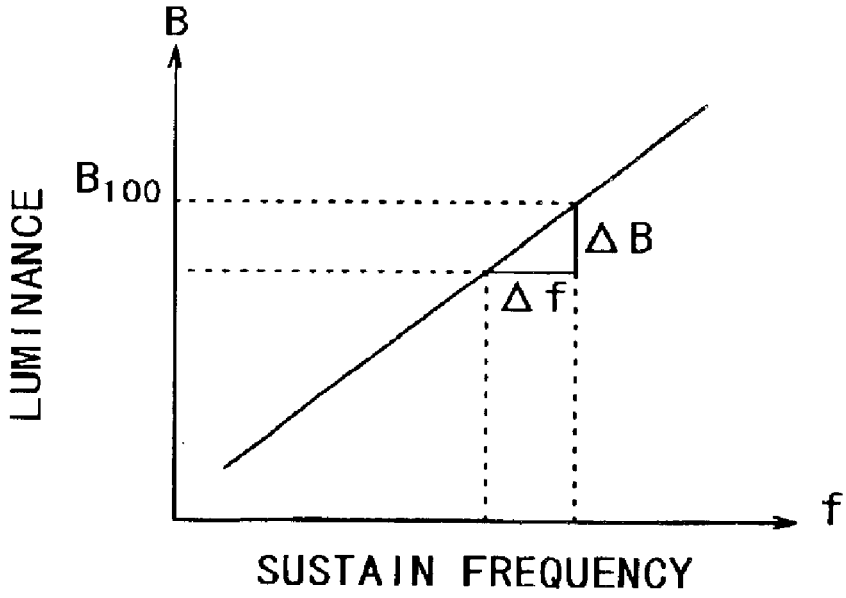
FIG. 3B is a characteristic diagram showing the relationship between a sustain frequency and a luminance.
Figure 4:
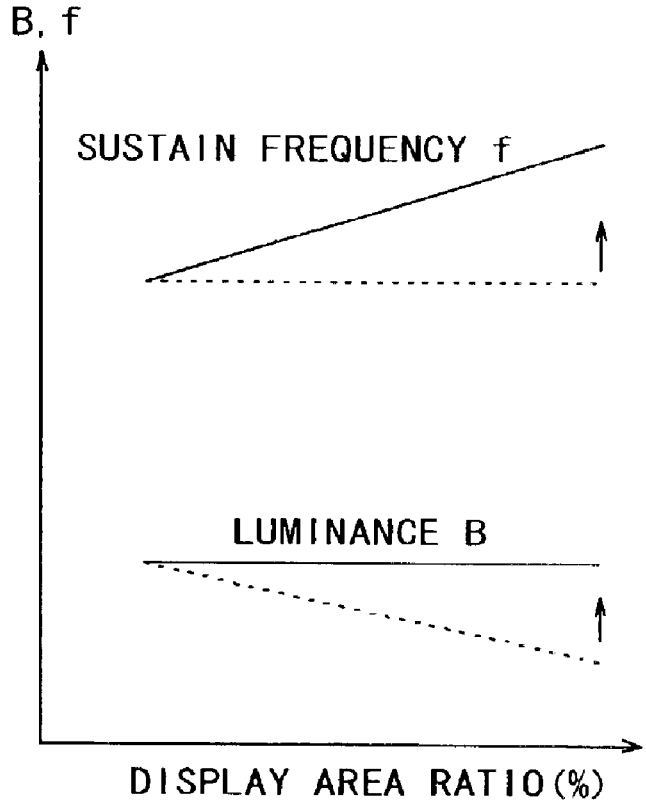
FIG. 4 is a graph for explaining a luminance correction method according to the first embodiment.

Regarding the light emission luminance derived from plasma discharge, the relationship shown in FIG. 3B is known as an experimental fact. That is, the luminance is in linear proportion to the frequency of the input pulses (sustain pulses) to the sustain electrodes 17 or to the number of the input pulses per unit time. In this embodiment, therefore, the frequency adjuster 34 controls the frequency or number of the sustain pulses, which is kept constant in the related art, in accordance with the display area ratio for correcting, to the reference value B100, the luminance lowered on the basis of the display area, as shown graphically in FIG. 4. In the plasma display device, the light emission luminance on the screen is dependent, in principle, on "how many pulses are inputted during a predetermined light emission period", and this signifies "the frequency or number of sustain pulses" in the present invention. For the purpose of simplifying the description, "frequency or number of sustain pulses" will be referred to merely as "frequency" in the following explanation.

The frequency adjuster 34 adjusts the sustain frequency as follows on the basis of the display area ratio inputted from the ON level discriminator 33 and outputs the obtained value to the sustain driver 35.

First, the luminance fall ΔB from the luminance reference value B100 is calculated in accordance with the display area ratio (FIG. 3A). It is seen from FIG. 3B that the luminance fall ΔB is in linear proportion to the frequency increment Δf for raising the luminance correspondingly. In other words, when ΔB is x % of the reference value B100, Δf is x % of the standard frequency fst. Therefore, $$\Delta B = B100 \times 0.01x,\ \Delta f = fst \times 0.01x$$

$$\Delta f = (fst/B100) \times \Delta B \quad (1)$$

Consequently, the sustain frequency fst+Δf at the luminance of B100 can be deduced from the luminance fall ΔB. Thus, from the correlation among the three characteristics, the frequency correction value can be uniquely deduced through the procedure of "display area ratio"→"luminance fall ΔB"→"sustain frequency fst+Δf". The sustain frequency fst+Δf thus obtained indicates a frequency for canceling out the variation ΔB derived from the display area ratio and correcting the luminance always to the reference value B100. Regarding such correlation among the three factors, since the linearity is firm as mentioned, it is possible to obtain a proper equation of relationship by measuring the characteristic values at two points minimally in the actual plasma display device.

Figure 5:
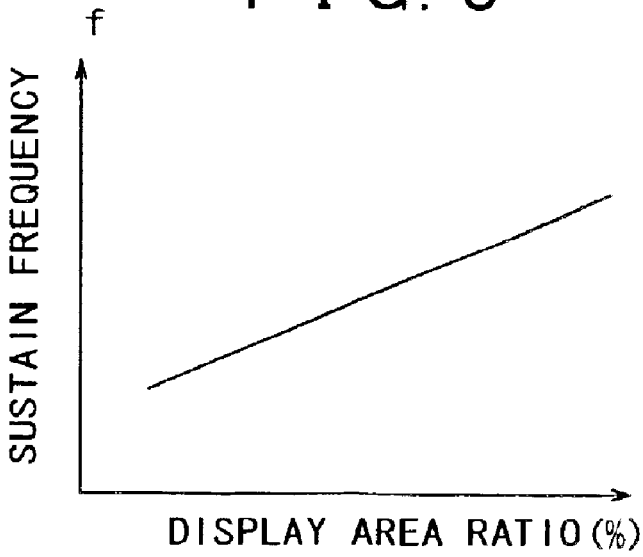
FIG. 5 graphically shows the input/output characteristic of the display area ratio and the sustain frequency stored in a frequency adjuster in the plasma display device according to the first embodiment.

As a result, the correction frequency relative to the display area ratio shown in FIG. 5 is calculated in accordance with the standard characteristic of the device. Then in the frequency adjuster 34, the relation between (display area ratio) and (correction frequency) of FIG. 5 is held in the form of a table or a conversion equation, and a correction value for the sustain frequency is calculated directly from the input display area ratio. In a modification; first the luminance fall ΔB may be calculated from the display area ratio on the basis of the relation shown in FIG. 3A, and then the frequency Δf and the correction value fst+Δf may be calculated from Eq. (1) given above.

Next, the operation of this plasma display device will be explained below. It is supposed here that gradation control is executed according to the sub-field method, and the fundamental reset, address and sustain operations in each sub-field are performed in normal modes.

Initially, the operation in one sub-field will be described. In a reset period, the sustain driver 35 applies pulses of a predetermined value to the entire sustain electrodes 17X and 17Y in a normal mode, thereby discharging the sustain electrodes so that either a state with uniform wall charges or a state without any wall charge is formed homogeneously on the protective layer 20 of the entire pixel regions.

In a succeeding address period, the operation is performed also in a normal mode. The sustain driver 35 outputs scanning pulses sequentially to the parallel sustain electrodes 17Y, and simultaneously the data driver 36 applies data pulses to the address electrodes 13 in synchronism with the scanning timing. The data pulses are based on the signal generated from the video data DV, and each is a binary pulse corresponding to emission or non-emission of light from the relevant pixel. The value of these pulses is so set that, only when a voltage is applied to both of the sustain electrodes 17Y and the address electrodes 13, an address discharge is generated beyond the discharge start voltage. Therefore, an address discharge is generated in either the light emission or non-emission pixel in accordance with the state at the reset time, whereby the wall charges are selectively left only in the light emission pixels.

The address discharge control operation is performed as follows. First, the A/D converter 31 converts the input video signal SV into 8-bit digital signal, i.e., video data DV indicating each of the trichromatic luminance per pixel, on the basis of sampling control executed by the timing controller, and then supplies the video data DV sequentially to the image memory 32. In the video data DV, the luminance component ratios of the respective bits are 1:2:4:8:16:32:64:128 in this order from the least significant bit, and the video data are quantized with the maximum luminance being binary 11111111, i.e., 255. The image memory 32 separates the video data DV into eight bit data and stores such data in units of bit plane for example. Further the image memory 32 reads the bit plane data, which correspond to the sub-field to be displayed next, out of the stored video data DV in accordance with the timing control, and then outputs the read data to the data driver 36. Subsequently the data driver 36 generates binary data pulses on the basis of the input video data DV (bit data per pixel) and, in accordance with the timing control, outputs the binary data pulses to the address electrodes 13 which correspond to the individual pixels respectively.

In this embodiment, simultaneously with such addressing control, sustain pulse frequency control is executed for sustain discharge to be performed next.

First, the video data DV are read out per sub-field from the image memory 32 and then are inputted to the ON level discriminator 33. Subsequently the ON level discriminator 33 calculates the number of ON display pixels, in units of region r, from the video data DV of one sub-field, then finds the display area ratio, and inputs the same to the frequency adjuster 34. The frequency adjuster 34 deduces the estimated luminance fall ΔB from the input display area ratio, then calculates the frequency Δf, which corresponds to ΔB, from the characteristic table or conversion equation, and superposes the frequency Δf on the standard frequency fst to thereby correct the sustain frequency to the value fst+Δf based on the emission luminance of B100. The value thus corrected is outputted to the sustain driver 35.

In this manner, the correction value fst+Δf is inputted as a sustain frequency per sub-field to the sustain driver 35.

Therefore, the timing of the sustain driver 35 is controlled in response to the frequency fst+Δf and, in the sustain period, outputs the sustain pulses at this frequency to the entire sustain electrodes 17X and 17Y. At this time, in the ON display pixel, the potential of the wall discharge is superposed on the sustain pulses applied thereto, and a discharge is started between the sustain electrodes 17X and 17Y having reached the discharge start voltage, whereby discharge and light emission can be sustained during the application of the pulses. Since the sustain pulses are supplied at the corrected frequency fst+Δf, the luminance of the light emission pixel is corrected to the reference value B100.

Figure 6:
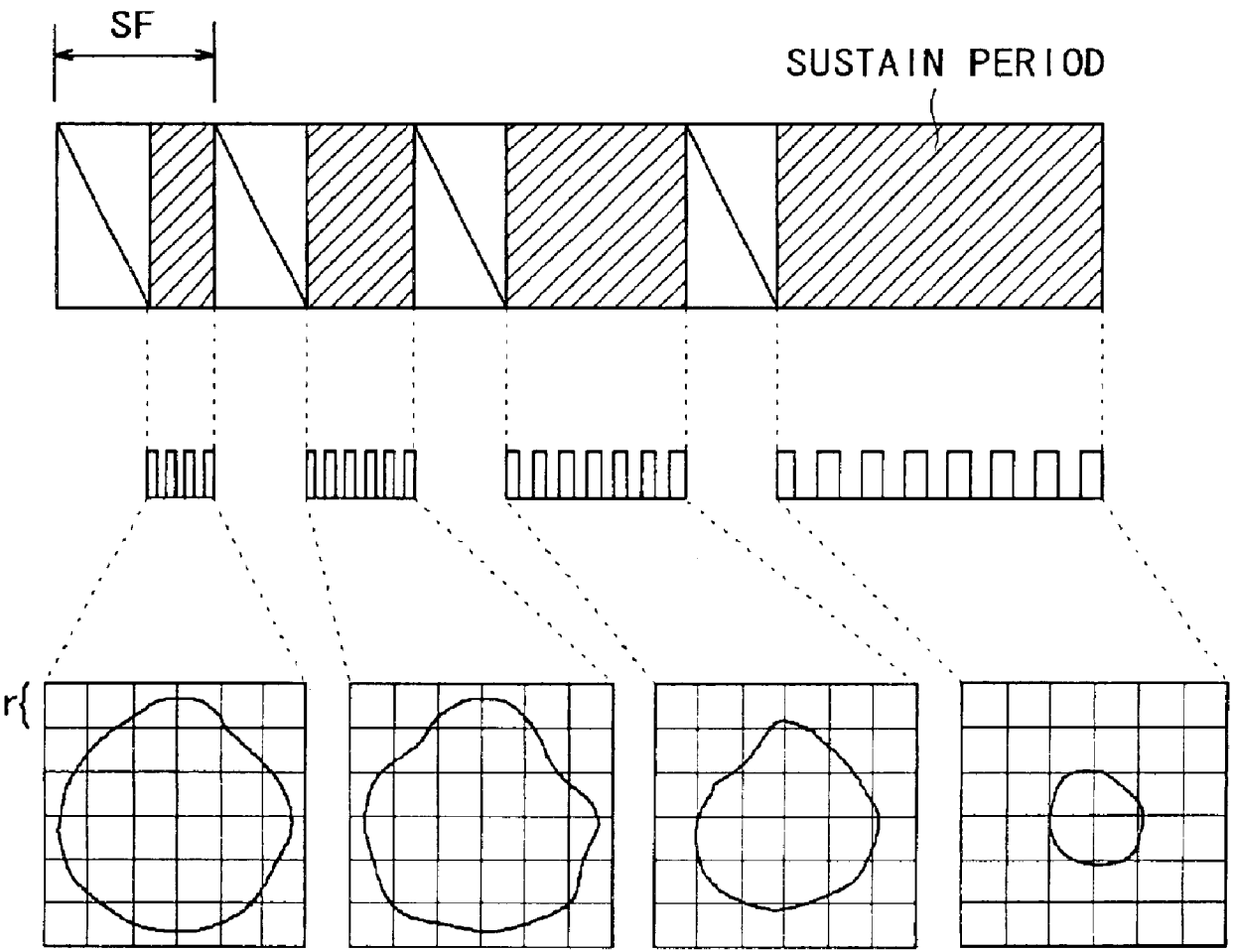
FIG. 6 illustrates an exemplary operation of the plasma display device according to the first embodiment.

The operation mentioned above is repeated per sub-field. FIG. 6 shows an example where any variation caused in the effective luminance is corrected by the sustain pulse frequency despite a change of the emission display area during the sub-field or field. Therefore, in this plasma display device, the ON display region can always be displayed at the constant luminance of the reference value B100.

Thus, in this embodiment, the area ratio of the ON display pixels in the display region is detected per sub-field by the ON level discriminator 33, then the luminance fall ΔB is deduced by the frequency adjuster 34, and the sustain frequency is corrected by the supplemental increment Δf, so that the screen can always be displayed at the maximum luminance (reference value B100) to thereby ensure proper luminance gradations corresponding exactly to the video signal. Consequently, it becomes possible to reproduce the image faithfully in conformity with the video signal.

[Modification]

In the first embodiment described above, an explanation has been given on a method of controlling the sustain frequency to correct the effective luminance so as to reproduce the image faithfully in conformity with the video signal. Further in a modified plasma display device of a structure similar to that of the first embodiment, it is also possible to control the luminance by the sustain frequency for displaying a bright screen to be brighter or a dark screen to be darker. This technique can be realized, as shown in FIG. 7, by altering the actual emission luminance Y nonlinearly with respect to the input luminance X of the video data.

Figure 7:
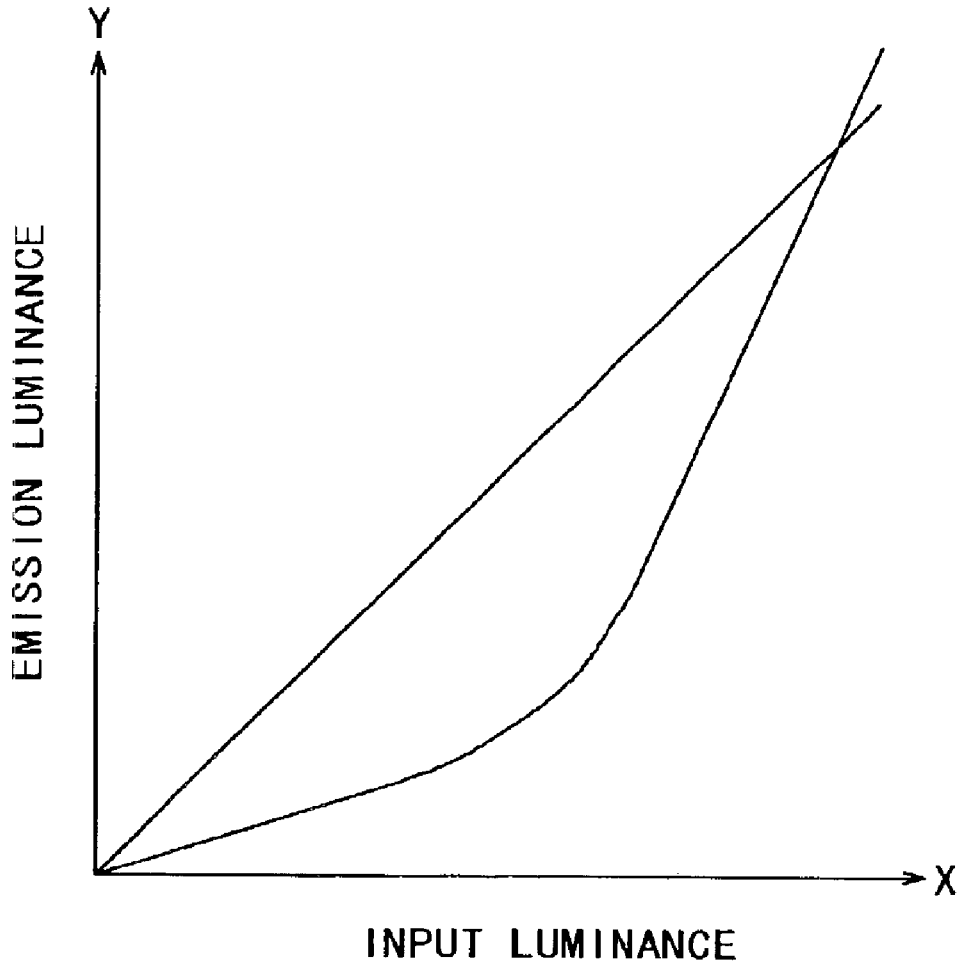
FIG. 7 graphically shows the luminance correction characteristic in the plasma display device according to a modification of the first embodiment.

In this modification, the brightness is detected, in units of field, as the ON display area ratio by the ON level discriminator 33, and the sustain frequency is converted, in conformity with the non-linear characteristic shown in FIG. 7, by the frequency adjuster 34 according to the detected brightness of each field. In this case, the display area ratio can be obtained as an average luminance calculated from the video data DV of one field. Further, the sustain frequency thus obtained is regarded as a reference frequency fb of each relevant field, and the sustain pulses during the period of each field are controlled by the reference frequency fb.

Thus, in this modification, the luminance of each one-field image is controlled by the sustain frequency in such a characteristic as to widen the dynamic range to thereby realize improved display of the well-emphasized image. Particularly in a dark screen, the sustain frequency is set to be lower than the normal frequency, hence achieving reduction of the flickering at the black level. Moreover, since the table, conversion equation or the like used in the frequency adjuster 34 can originally be prepared as desired, the frequency conversion system is changeable in compliance with the purpose.

Further, the ON level discriminator 33 is enabled to detect the brightness per sub-field, and in the frequency adjuster 34, the reference frequency fb is regarded as the standard frequency fst in the aforementioned first embodiment, so that the luminance correction per sub-field can also be performed simultaneously.

[Second Embodiment]

Figure 8:
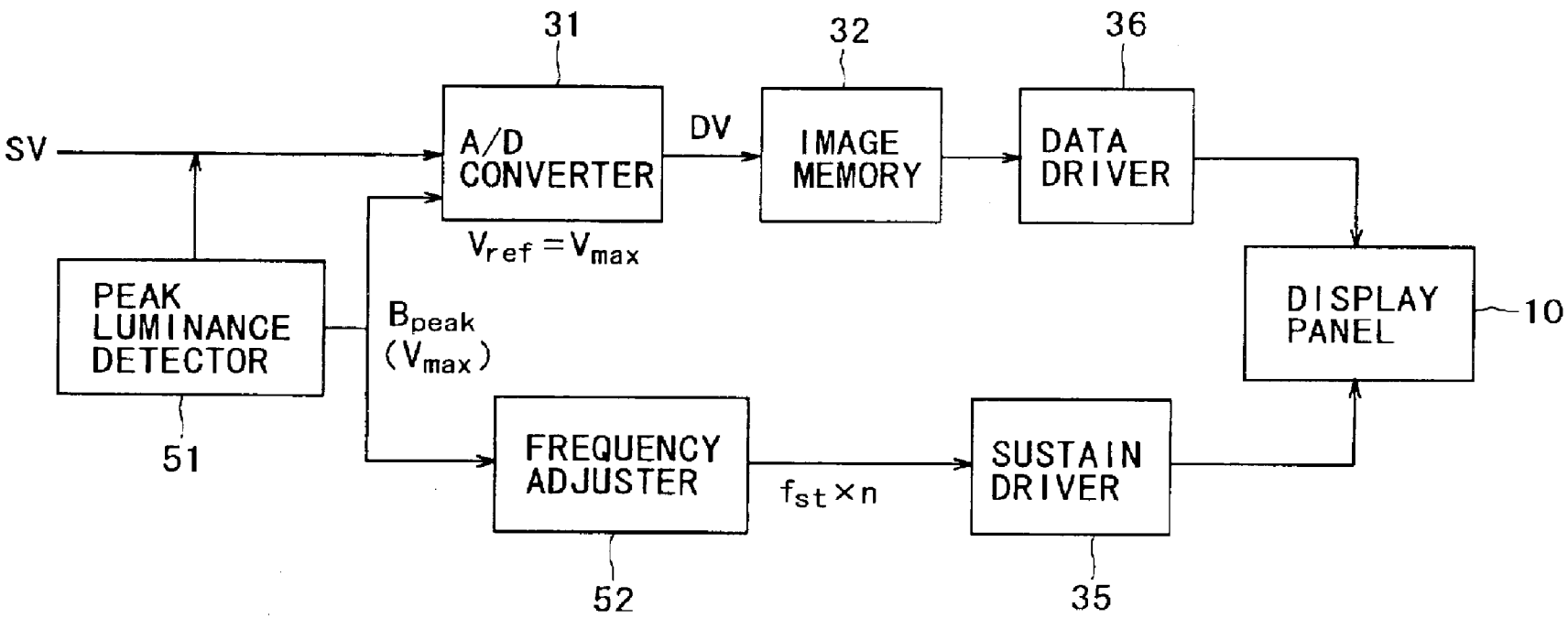
FIG. 8 is a block diagram showing the structure of a plasma display device according to a second embodiment.

FIG. 8 is a block diagram showing the structure of a plasma display device according to a second embodiment of the present invention. This plasma display device performs its display by assigning the maximum luminance (peak luminance value), in the light emission display period of each field, to the most significant bit of the gradation. The display device further comprises a peak luminance detector 51 and a frequency adjuster 52 in addition to the known configuration. Any components equal to those described already in connection with the first embodiment are denoted by the same reference numerals or symbols as those used in the first embodiment, and a repeated explanation thereof is omitted here.

The peak luminance detector 51 detects the peak luminance Bpeak of a video signal SV as the maximum amplitude Vmax per field. The peak luminance Bpeak (Vmax) is outputted to an A/D converter 31 and a frequency adjuster 52.

Figure 9:
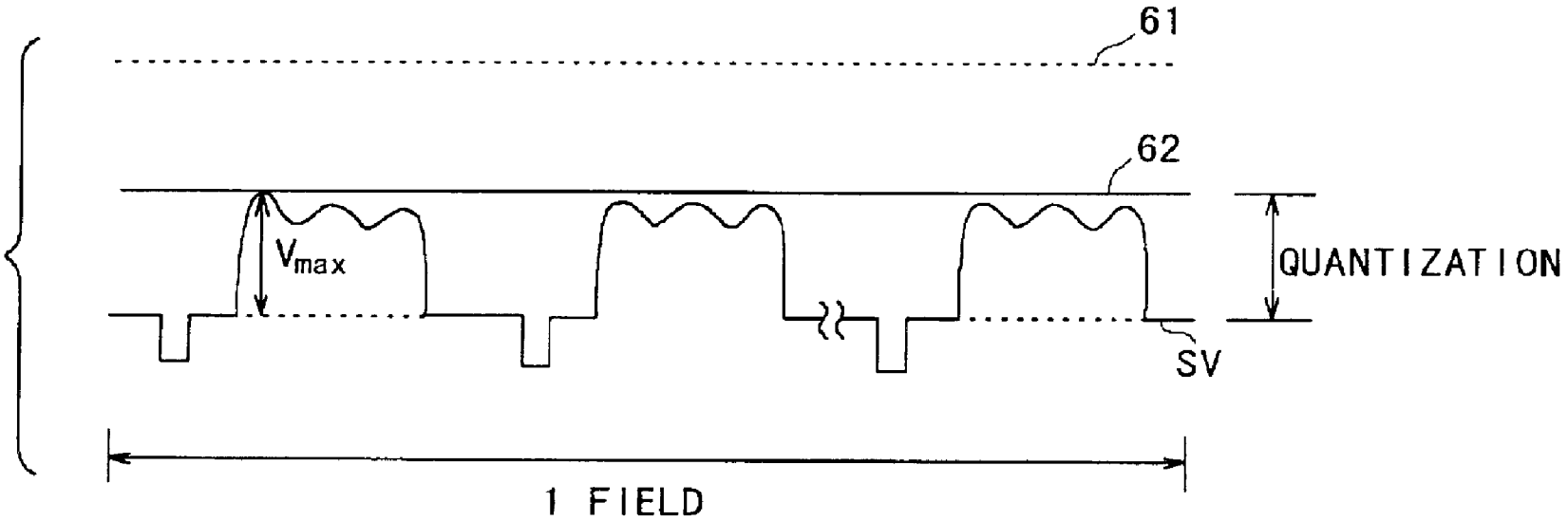
FIG. 9 is a graph for explaining a gradation control method according to the second embodiment.

The A/D converter 31 quantizes the input video signal SV to convert the same into video data DV. Here, as shown in FIG. 9, instead of normal fixed setting of the white level 61 to the most significant bit, the A/D converter 31 quantizes the video signal SV by assigning, to the most significant bit, the maximum amplitude level 62 given by the maximum amplitude Vmax from the peak luminance detector 51. In this manner, the A/D converter 31 adopts a variation reference as the maximum amplitude level 62 set per field, thereby generating video data DV where the maximum value is composed of full bits (11111111) with respect to any field.

The A/D converter 31 can be realized by employing, for example, a flash type converter which is capable of varying its upper reference voltage Vref and updating the value thereof in response to each input of the maximum amplitude Vmax. That is, using the upper reference voltage Vref updated by the maximum amplitude Vmax per field, the input value actually in a range of 0 to Vmax (V) is resolved into 255 gradations.

In the sub-field driving method, the above process corresponds to continuous driving of the entire sub-fields SF1–SF8 for emission of light. Consequently, the luminance of each image is displayed by the number of full gradations. In this case, however, the luminance fails to be displayed properly. According to the related art, the luminance is expressed by time modulation where light is emitted at a predetermined constant luminance merely for a time length corresponding to the number of bits of the video data, and the references of such luminance and gradations are based on the white level. However, the full-range luminance here has a value unique to each field, and cannot be regarded as an absolute reference of the luminance. Therefore, it is necessary here to correct the luminance in compliance with continuous widening of the gradation range to the maximum More specifically, the emission luminance needs to be lowered on the average during the light emission period so that the temporal integral of the luminance coincides with the value to be displayed originally. Further, as mentioned in connection with the first embodiment, the sustain frequency and the luminance are in a linear proportional relation. Therefore, in the second embodiment, the frequency adjuster 52 corrects the sustain frequency in such a manner as to attain an emission luminance which is not based on the white level but conforms with the full-range luminance per field.

In response to the peak luminance Bpeak (Vmax) inputted from the peak luminance detector 51, the frequency adjuster 52 calculates its ratio n to the white level and then multiplies the standard frequency fst by the ratio n to correct the sustain frequency. The correction value is outputted to the sustain driver 35.

As a result, in this plasma display device, the number of gradations is expressed by full bits, and simultaneously the luminance is adjusted by the sustain frequency in accordance with an increase of the light emission time.

Figure 10A:
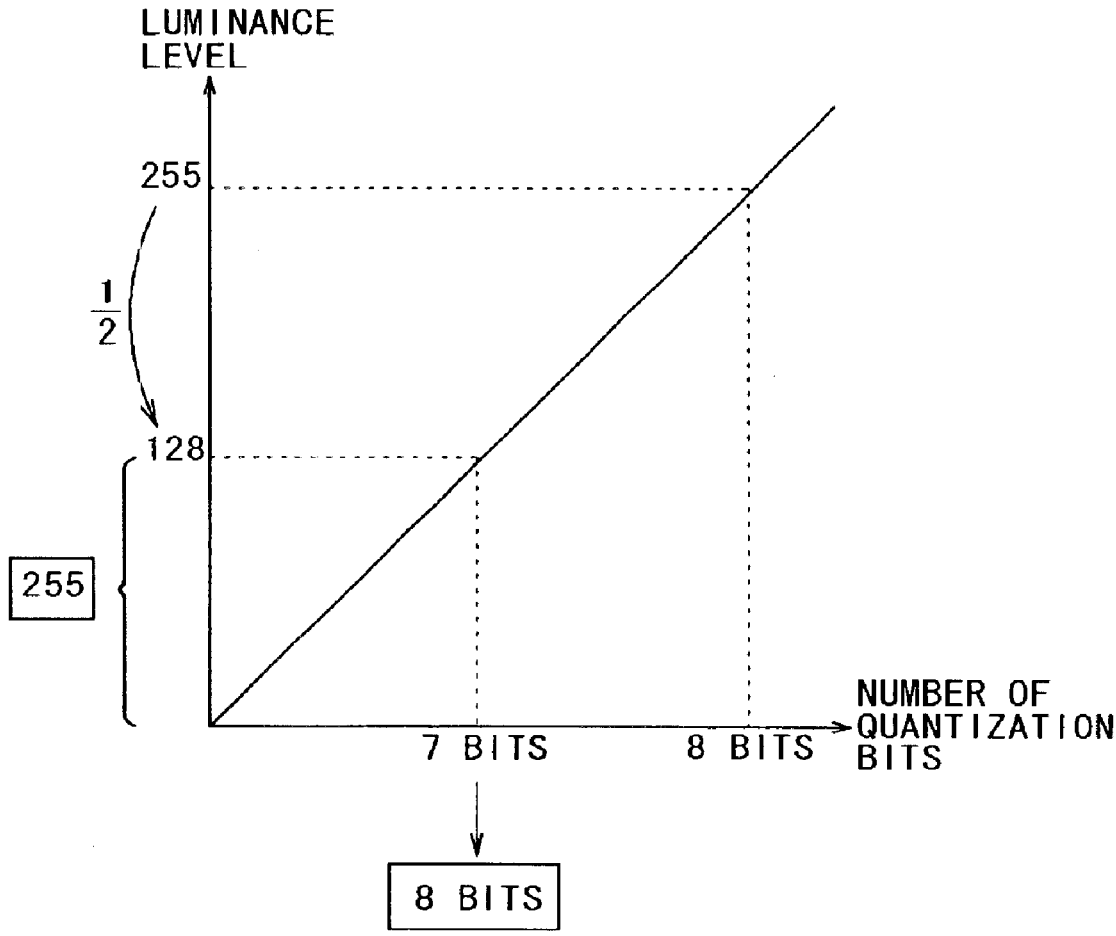
FIG. 10A is a graph for explaining quantization related to the gradation control method according to the second embodiment.
Figure 10B:
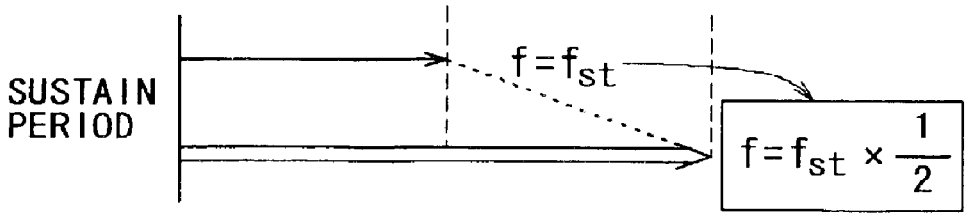
FIG. 10B is a graph for explaining control of a sustain period.

Next, the operation of this plasma display device will be explained below. With reference to FIGS. 10A and 10B, an explanation will be given also on one concrete example of displaying a field image where the maximum amplitude Vmax is 0.5V when the video signal SV is in a range of 0 to 1V.

In response to the input video signal SV, first the peak luminance detector 51 detects the maximum amplitude Vmax (peak luminance Bpeak) in each field, and then supplies the detected amplitude to the A/D converter 31. Further the peak luminance detector 51 outputs the maximum amplitude Vmax thus obtained to the A/D converter 31 and the frequency adjuster 52.

The A/D converter 31 executes analog-to-digital conversion of the video signal SV. In this case, the A/D converter 31 assigns the most significant bit to the input peak luminance Bpeak, and then converts the input signal into video data DV per field, whereby full bits are assigned to the video data DV indicating the maximum luminance in each field image.

In this example, the upper reference voltage Vref is set to 0.5V, and the video signal SV is processed through analog-to-digital conversion. As shown in FIG. 10A, according to the conventional gradation control system, 8 bits ($2^8$=256 gradations) for example are assigned to the full-range luminance, and the entire luminance levels are graded previously so as to correspond to stages 0–255. That is, when the video signal SV is in a range of 0 to 1V, the A/D converter uses the fixed upper reference voltage Vref of 1V and resolves the input value of 0–1V into 255 stages. In this manner, the conventional gradation control is based on the absolute luminance referring to the white level. For this reason, the video signal SV of 0.5V is converted into video data of 256/2=128 stages, i.e., (01111111), and the image is displayed in 128 gradations corresponding to 7 bits. Meanwhile in this example where setting of the upper reference voltage Vref is changed, the signal SV corresponding to 7 bits is converted into video data DV of full 8 bits (11111111), and the luminance range corresponding to 7 bits in the related art is displayed in 256 gradations.

The video data DV thus obtained are read into the image memory 32 as known, and are read out therefrom to the data driver 36 at predetermined timing in the address period of each sub-field. The read video data DV are supplied to each address electrode 13 on the display panel 10.

Consequently, the pixel of each sub-field is turned on or off in a manner to be displayed in full gradations where the maximum luminance is set to the peak luminance value Bpeak. That is, in this example, the luminance range corresponding to 7 bits is displayed in 256 gradations.

On the other hand, the frequency adjuster 52 deduces, from the input maximum amplitude Vmax (peak luminance Bpeak), the ratio n with respect to the white level of the peak luminance value Bpeak, then multiplies the standard frequency fst by the ratio n to calculate the correction value of the sustain frequency, and outputs the correction value to the sustain driver 35.

In the sustain period, the sustain driver 35 outputs the sustain pulses at the corrected frequency to the entire sustain electrodes 17X and 17Y. At this time, the luminance of the ON display pixel is lowered correspondingly to the correction of the sustain frequency, so that the luminance of each pixel, which is the temporal integral of the entire sub-fields SF1–SF8, is corrected to the proper value to be displayed.

The upper line shown in FIG. 10B represents the 7-bit luminance by the 7-bit time length. In the example of this embodiment, the luminance equivalent thereto is represented by the 8-bit time length by the lower line in FIG. 10B. Accordingly, the luminance during emission needs to be such that the upper-line luminance and the integrated luminance are mutually coincident. As shown in FIG. 10A, the 7-bit luminance of the video data DV is a half of the 8-bit luminance. In this case, therefore, the sustain frequency is a half of the standard frequency fst.

As described above, the time modulation of the luminance is so executed as to display the image of each field in full gradations, and the frequency modulation is so executed as to correct the luminance to the proper value.

Such a series of operations are repeated with regard to the video signal SV of every field. Consequently, full-gradation display can be carried out even in case the luminance of the image is extremely low, and the luminance value itself can be adjusted properly by the sustain frequency in accordance with an increase of the light emission time.

In this second embodiment, as mentioned, the peak luminance value Bpeak is detected per field, then the detected value is assigned to the most significant bit, and the luminance in each sub-field is modulated to perform gradation display, whereby the image of each field can be displayed in full gradations with the maximum luminance being set to the peak luminance value Bpeak. Accordingly, it becomes possible to achieve satisfactory display always with a superior image quality. Particularly with regard to any dark image as a whole, high-gradation display is attainable even at low luminance, hence realizing effective emphasis in any delicately bright and dark portions. In this display method, the number of gradations is produced by temporal modulation, so that a greater number of sub-fields are ON-displayed as compared with the number in the conventional method. Also in this embodiment, the luminance is controlled by the sustain frequency in accordance with an increase of the light emission time, whereby the luminance of each pixel can be corrected to its proper value.

[Third Embodiment]

Figure 11:
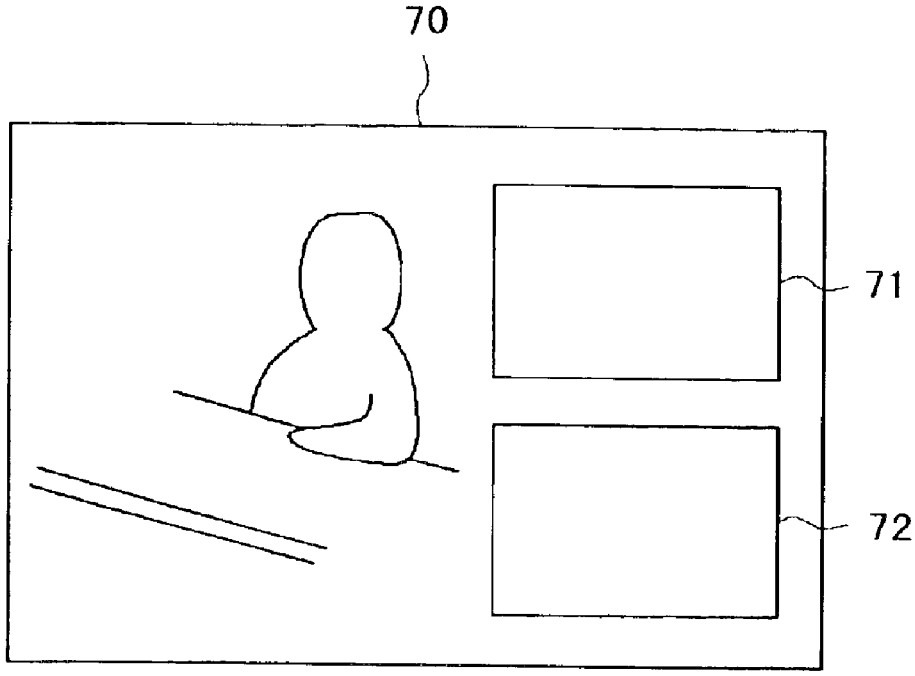
FIG. 11 shows how a screen is displayed on a plasma display device according to a third embodiment.

FIG. 11 shows how a screen is displayed on a plasma display device according to a third embodiment of the present invention. Since the display system employed in each of the first and second embodiments utilizes modulation of the sustain frequency, the explanation given above relates to display of a single screen on the device, in view of the structure of its display panel. In this third embodiment, an explanation will be given on a method of applying the above display system to another case of displaying a plurality of screens simultaneously on the screen. Also in the third embodiment, any components equal to those used in the foregoing embodiments are denoted by the same reference numerals or symbols.

In one example, a main screen 70 is displayed on the whole screen of the device, and child screens 71 and 72 are displayed on portions of the screen in place of the main screen. A desired number of such child screens are settable as child screens 71, 72, . . . and so forth. In the third embodiment, the aforementioned luminance control is executed with reference to one of the plural displayed screens, e.g., the main screen 70, and the luminance of any of the other displayed screens, such as the child screens 71 and 72, is adjusted in the following manner.

Figure 12:
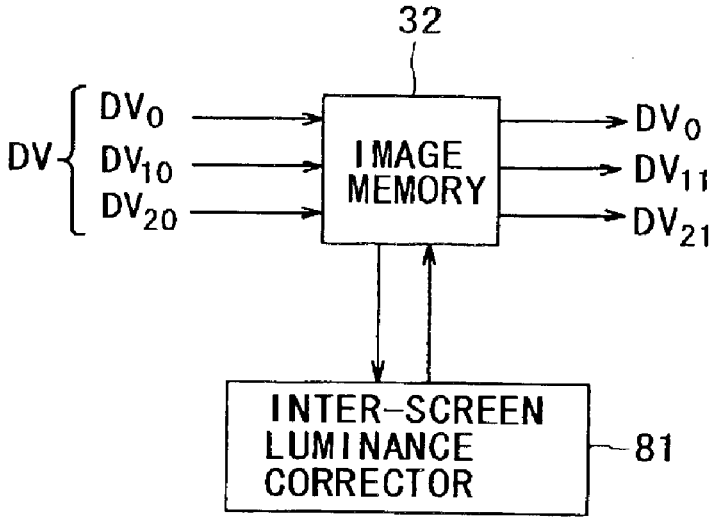
FIG. 12 is a block diagram showing principal components of the plasma display device according to the third embodiment.

FIG. 12 is a block diagram showing principal components of the plasma display device according to the third embodiment, and FIGS. 13A, 13B and 14A, 14B graphically explain a concrete method for such luminance correction. With the exception of these principal components, the fundamental structure of this plasma display device is the same as that of the device in the first or second embodiment for example. Further video data DV (DV0, DV10, DV20) corresponding to the plural display screens 70–72 are captured so that the plural screens can be displayed on a single screen of the device, as illustrated in FIG. 11. Here, an inter-screen luminance corrector 81 is provided for transferring the video data DV to or from an image memory 32 which is equal to the aforementioned one used in the foregoing embodiments.

The inter-screen luminance corrector 81 adjusts the luminance of the child screens 71 and 72 on the data in accordance with the luminance of the main screen 70. This luminance corrector 81 has a function of detecting the peak luminance values P0, P10, P20 from the respective video data DV0, DV10, DV20 of the main screen 70 and the child screens 71, 72, and another function of correcting the luminance distribution of the displayed images in the child screens 71, 72 in accordance with the detected peak luminance value P0 of the-main screen 70. (Here, the term "peak luminance value" signifies a value on the bit data, and it is different from the peak luminance value Bpeak in the second embodiment.)

As for its concrete operation, first the video data DV0, DV10, DV20 are read out from the image memory 32 and are inputted to the inter-screen luminance corrector 81. Then the luminance corrector 81 detects the respective peak luminance values P0, P10, P20 from the video data DV0, DV10, DV20. Subsequently, the luminance corrector 81 corrects the entire luminance distribution of the child screens 71, 72 in such a manner as to conform the respective peak luminance values P10, P20 with the peak luminance value P0 of the main screen 70.

[Luminance Correction for Child Screen 71]

Figure 13A:
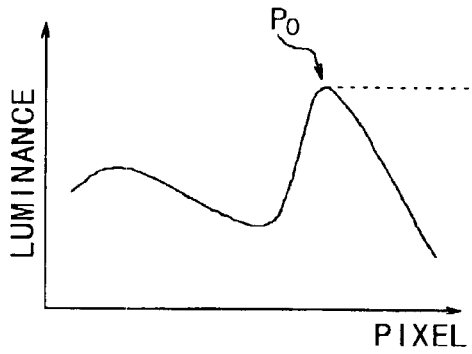
FIG. 13A graphically shows a luminance distribution of a main screen in the third embodiment.
Figure 13B:
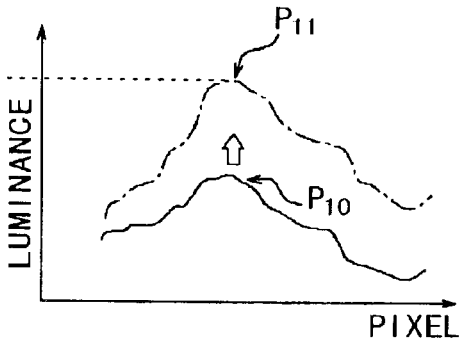
FIG. 13B graphically shows a luminance distribution of a child screen in the third embodiment.

FIGS. 13A and 13B show the luminance distribution of the main screen 70 and that of the child screen 71, respectively. In this case, the peak luminance value P10 of the child screen 71 is lower than the peak luminance value P0 of the main screen 70. In such a state, if the luminance of the entire screens on the whole screen of the device is controlled with reference to the main screen 70, the luminance of the child screen 71 is changed passively with the control executed for the main screen 70. That is, although the child screen 71 represents the video data DV10, the luminance control thereof is executed completely regardless of the luminance of the video data DV10, whereby effective control of the luminance fails to be achieved and, in the worst case, even the proper display may not be attained.

In view of the above problem, this embodiment is so contrived that the peak luminance value P10 of the child screen 71 is raised up to a peak luminance value P11 which is equal to the peak luminance value P0 of the main screen 70, whereby the control conditions relative to the child screen 71 and the main screen 70 are rendered uniform. Consequently, the child screen 71 no longer displays the luminance faithful to the original video data DV10, and a balance of the luminance can be attained in relation to the main screen 70, so that the luminance control executed at random over the entire screen of the device gives a certain effect to the child screen 71 as well. In case the contrast difference is distinct between the main screen 70 and the child screen 71 for example, such contrast difference is emphasized and consequently it becomes more difficult for the viewer to see either screen. This is partly derived from the fact that, in the sub-field driving method where the luminance is controlled in connection with the gradations, the absolute number of gradations is smaller in the darker screen and the screen quality is lower. Therefore, the mutual viewability of the displayed screens can be increased by rather uniforming the luminance between the displayed screens.

With a raise of the peak luminance value P10 to the peak luminance value P11, the whole luminance distribution of the child screen 71 is also raised from a solid line in FIG. 13B to an alternate long and short dash line for correction of the luminance. For example, the luminance denoted by the solid line is amplified at a gain conforming with the change of the peak luminance value, or an offset corresponding to the change of the peak luminance value is given to the luminance of the solid line.

The inter-screen luminance corrector 81 thus corrects the luminance distribution of the child screen 71, and then outputs the luminance-corrected video data DV11 to the image memory 32. Subsequently, the video data DV11 is stored in the image memory 32 and is used to display the child screen 71 as in the known manner of displaying a child screen.

[Luminance Correction for Child Screen 72]

Figure 14A:
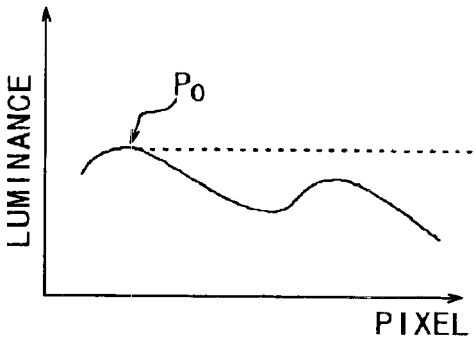
FIG. 14A graphically shows another luminance distribution of the main screen in the third embodiment.
Figure 14B:
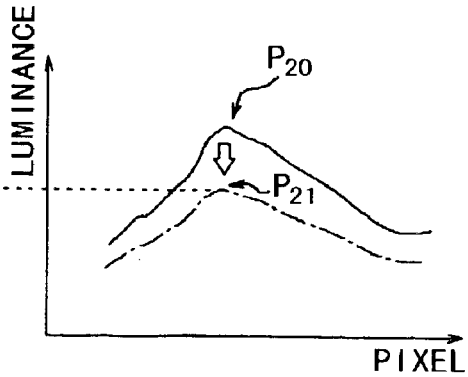
FIG. 14B graphically shows another luminance distribution of the child screen in the third embodiment.
Figure 15:
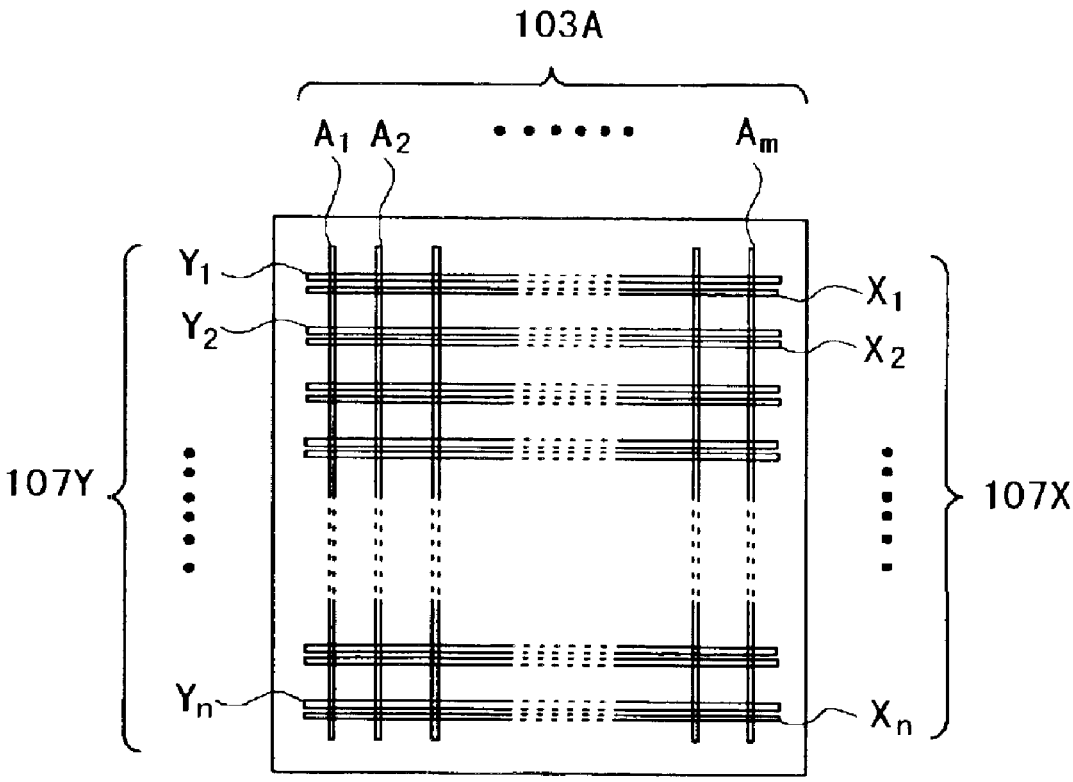
FIG. 15 is a block diagram showing a fundamental structure of a display panel in a conventional plasma display device.
Figures 16A, 16B, 16C:
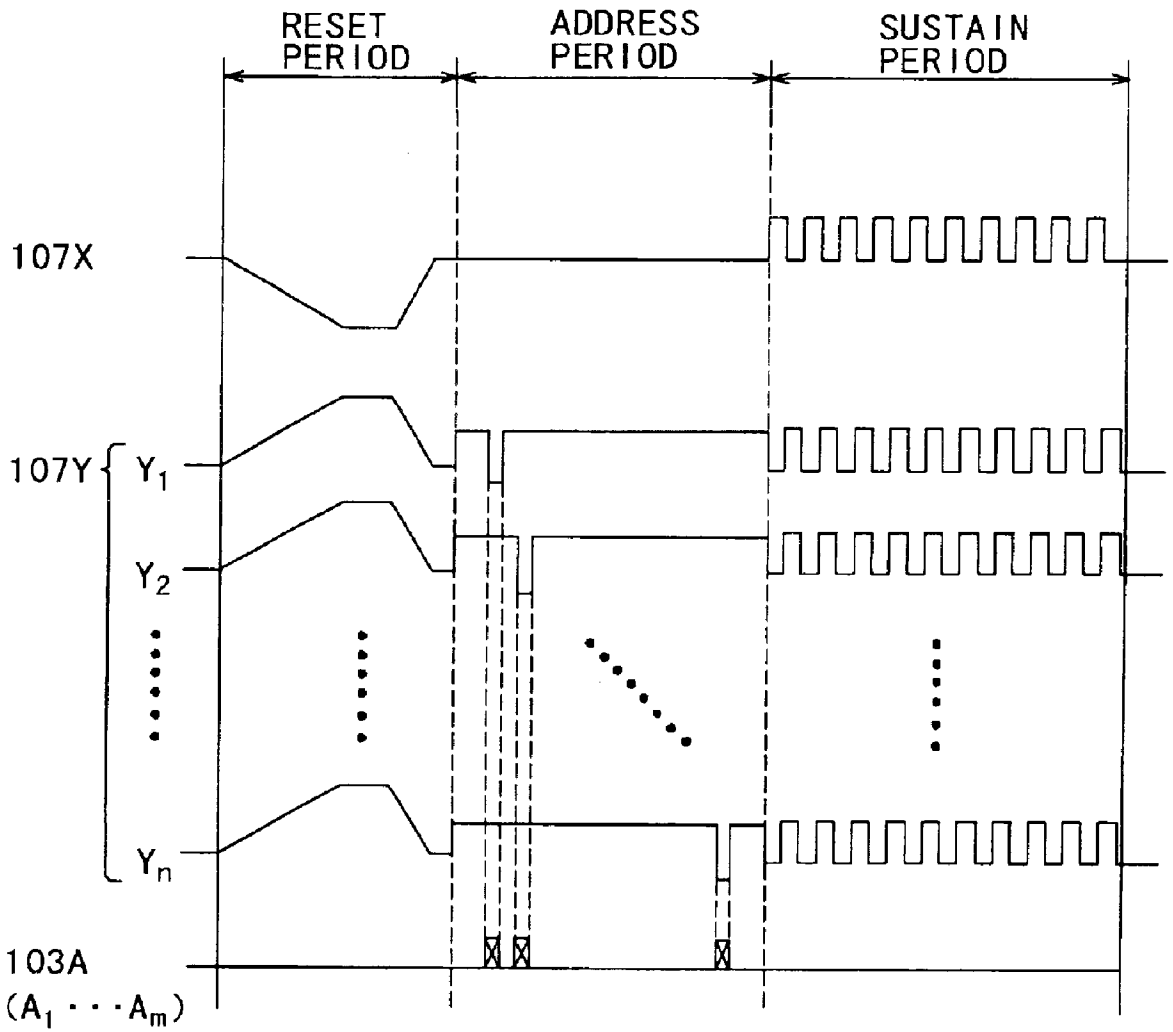
FIGS. 16A to 16C graphically show voltage waveforms for explaining a basic driving method in the conventional plasma display device.
Figure 17:
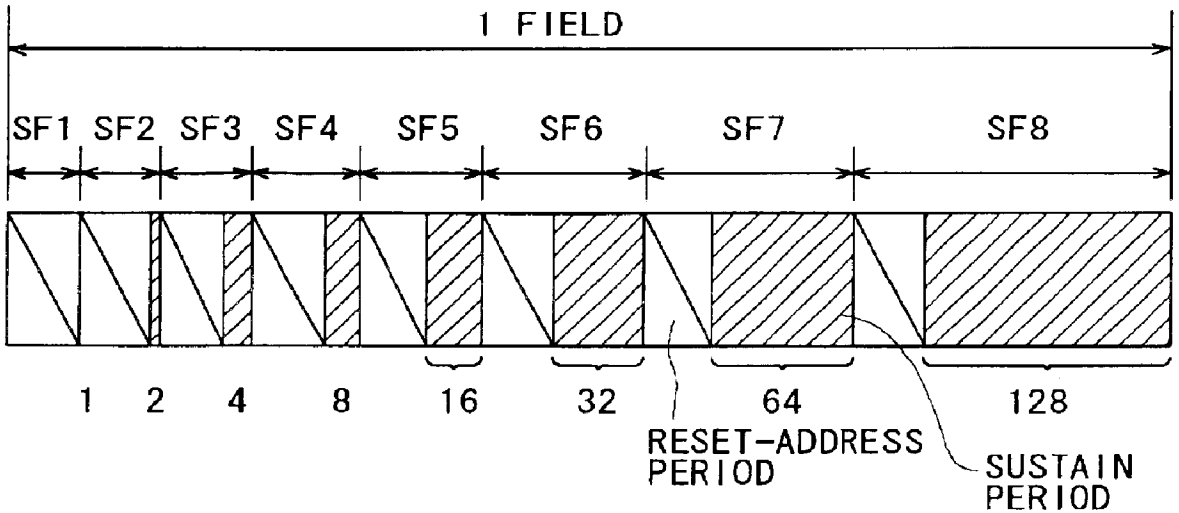
FIG. 17 is a diagram showing a driving sequence by a sub-field method in the conventional plasma display device.
Figure 18:
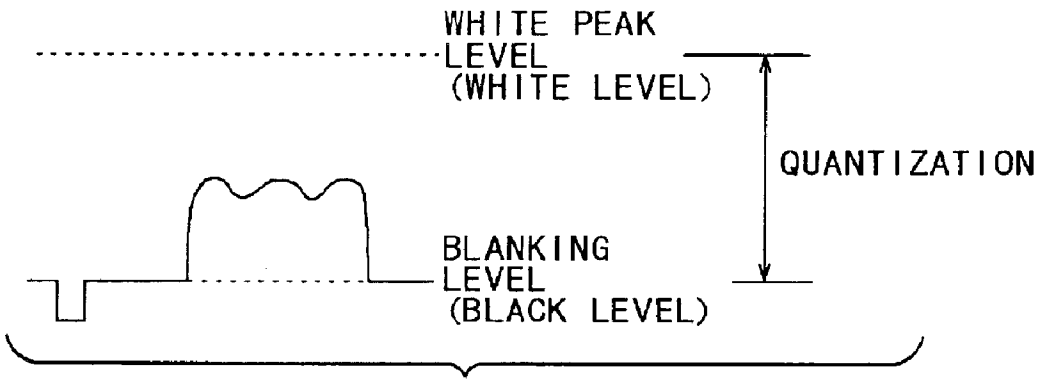
FIG. 18 graphically shows a schematic waveform of a video signal.

FIGS. 14A and 14B show the luminance distribution of the main screen 70 and that of the child screen 72, respectively. In this case, the peak luminance value P20 of the child screen 72 is higher than the peak luminance value P0 of the main screen 70. In such a state, if the luminance of the entire screens on the whole screen of the device is controlled with reference to the main screen 70, the display quality of the child screen 72 may be deteriorated for the same reason as in the foregoing case of the child screen 71. Also in execution of such control as to raise the luminance of the main screen 70, the luminance of the child screen 72 is saturated on the white level side to consequently crush the gradations on the high luminance side.

In view of the above problem, this embodiment is so contrived that the peak luminance value P20 of the child screen 72 is lowered down to a peak luminance value P21 which is equal to the peak luminance value P0 of the main screen 70 so that the child screen 72 is under the same control condition as the main screen 70, whereby a balance of the luminance can be attained between the child screen 72 and the main screen 70, and therefore the mutual viewability of the displayed screens can be increased with another advantage that the luminance control executed at random over the entire screen of the device gives a certain effect to the child screen 72 as well.

With a reduction of the peak luminance value P20 to the peak luminance value P21, the whole luminance distribution of the child screen 72 is also reduced from a solid line in FIG. 14B to an alternate long and short dash line for correction of the luminance. For example, the luminance denoted by the solid line is amplified at a gain conforming with the change of the peak luminance value, or an offset corresponding to the change of the peak luminance value is given to the luminance of the solid line.

The inter-screen luminance corrector 81 thus corrects the luminance distribution of the child screen 72, and then outputs the luminance-corrected video data DV21 to the image memory 32. Subsequently, the video data DV21 is stored in the image memory 32 and is used to display the child screen 72 as in the known manner of displaying a child screen.

Thus, each of the child screens 71 and 72 is displayed at the luminance corrected in conformity with the luminance of the main screen 70. If the sustain frequency is changed by any luminance control (e.g., the luminance adjustment in the first or second embodiment) executed with reference to the main screen 70, the displayed images of the child screens 71 and 72 are luminance-modulated substantially with the same effect as the displayed image of the main screen 70.

According to this embodiment, when a plurality of screens are to be displayed simultaneously on the screen of the device, the luminances of the child screens 71 and 72 are previously conformed, on the data, with the luminance of the main screen 70, and the luminance control is executed by utilizing the sustain frequency modulation with reference to the main screen 70, whereby the displayed images of the child screens 71 and 72 are luminance-modulated substantially with the same effect as the displayed image of the main screen 70. Therefore, the display luminances of the child screens 71 and 72 are also controlled adequately in addition to optimal setting of the luminance of the main screen 70, hence achieving full exhibition of the essential effect in the luminance control. Further, the mutual viewability can be enhanced between the main screens 70 and the child screens 71 and 72.

It is to be understood that the present invention is not limited to any of the above embodiments alone, and a variety of modifications thereof may also be carried into effect. For example, besides the first embodiment and its modification where the display luminance is corrected to a proper value according to the nonlinear characteristic to improve the dynamic range, the present invention is capable of detecting the luminance, which is to be displayed, from another parameter of the area ratio of the ON display pixels, and controlling the sustain frequency on the basis of the detected value, wherein the luminance characteristic is alterable to some other ones as desired in addition to that explained in connection with the first embodiment.

Besides the second embodiment where the peak luminance value Bpeak is detected as the maximum amplitude value Vmax, the peak luminance value may be detected as a peak-to-peak (P—P) value based on the pedestal level or black level. Further in addition to the second embodiment where the peak luminance value Bpeak is assigned to the most significant bit, the average luminance value may be used instead of the peak luminance value Bpeak, and equal gradation control may be executed. In this case, however, any luminance value over the average exceeds the dynamic range, and there may occur an undesired "white blur" state where the signal value is saturated at the white level. Therefore, in case the screen quality is widely deteriorated, the parameter of the maximum amplitude value Vmax may be selectively switched in accordance with the situation by using the maximum amplitude value Vmax as the peak luminance value Bpeak or the like.

Further in the third embodiment, when correcting the luminance of the child screen 71 or 72 in accordance with the luminance of the main screen 70, the peak luminance value P10 or P20 is conformed to the peak luminance value P0. However, the peak-to-peak value of each display screen may be employed as well. Moreover, the index luminance value is not limited merely to any of such peak luminance values, and any of various luminance parameters is also applicable. Besides the above, the average luminance value or the like may also be used as in the second embodiment.

In the above embodiments, although the explanation has been given specifically on an example of expressing 256 gradations by eight sub-fields in the sub-field driving method, the number of gradations and that of sub-fields are not limited to the such numerical values alone.

What is claimed is:

1. A plasma display device wherein each pixel includes a pair of sustain electrodes, to which sustain pulses are applied during an emission period to thereby effect emission of light, and wherein gradations are expressed by dividing and modulating the emission display period in accordance with bit data which represent the luminance information per pixel, said device comprising:

luminance level detection means for detecting a reference luminance value as a modulation reference from said luminance information per predetermined display image, said reference luminance value being a maximum detected luminance value;

luminance data generation means for generating the bit data on the basis of said reference luminance value; and sustain frequency adjust means for adjusting the frequency or number of the sustain pulses during the emission display period in accordance with said reference luminance value.

2. The plasma display device according to claim 1, wherein said luminance data generation means generates the bit data by assigning said reference luminance value to a most significant bit.

3. A display method carried out in a plasma display device wherein each pixel includes a pair of sustain electrodes to which sustain pulses are applied during an emission period to thereby effect emission of light, and wherein gradations are expressed by dividing and modulating the emission display period in accordance with bit data which represent the luminance information per pixel, said method comprising the steps of:

calculating a reference luminance value as a modulation reference from the luminance information per predetermined display image, said reference luminance value being a maximum detected luminance value;

generating the bit data on the basis of said reference luminance value to divide and modulate the emission display period; and adjusting the frequency or number of the sustain pulses during the emission display period in accordance with said reference luminance value.

4. The display method according to claim 3, wherein said bit data are generated by assigning the reference luminance value to a most significant bit.

5. The display method according to claim 3, wherein said predetermined display image is a unit image of each field, and each field is divided and modulated by sub-fields which are formed by dividing the emission display period of one field in accordance with the bit place of said bit data.

6. A plasma display device wherein each pixel includes a pair of sustain electrodes to which sustain pulses are applied during an emission period to thereby effect emission of light, and wherein gradations are expressed by dividing and modulating the emission display period in accordance with bit data which represent the luminance information per pixel, said device comprising:

index detection means for detecting, when a plurality of screens are to be displayed simultaneously, an index luminance value as an index from each of the luminance information relative to the displayed images; and inter-screen luminance correction means for correcting the luminance distribution of a child screen, which is displayed in addition to a main screen, in accordance with the index luminance value of the main screen using the luminance information for control out of the displayed screens.

7. The plasma display device according to claim 6, wherein said inter-screen luminance correction means corrects the luminance distribution in a manner to conform the index luminance value of said child screen with the index luminance value of said main screen.

8. The plasma display device according to claim 6, wherein said index luminance value is a peak luminance value.

9. The plasma display device according to claim 6, wherein said index luminance value is an average luminance value.

10. The plasma display device according to claim 6, wherein said luminance control is executed by first detecting the area ratio, with respect to the display area, of the pixels having any luminance higher than a predetermined value in said main screen, and adjusting the frequency or number of the sustain pulses in accordance with the area ratio in such a manner that the luminance in the display region satisfies a predetermined reference value.

11. The plasma display device according to claim 6, wherein said luminance control is executed by first detecting a reference luminance value as a modulation reference from the luminance information of said main screen, then generating the bit data on the basis of the detected reference luminance value, subsequently dividing and modulating the emission display period, and adjusting the frequency or number of the sustain pulses in the emission display period in accordance with said reference luminance value.

* * * * *